US008210794B2

(12) United States Patent
Nolcheff et al.

(10) Patent No.: US 8,210,794 B2
(45) Date of Patent: Jul. 3, 2012

(54) AXIAL-CENTRIFUGAL COMPRESSOR WITH PORTED SHROUD

(75) Inventors: Nick A. Nolcheff, Chandler, AZ (US); Michael T. Barton, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 864 days.

(21) Appl. No.: 12/261,748

(22) Filed: Oct. 30, 2008

(65) Prior Publication Data

US 2010/0111688 A1 May 6, 2010

(51) Int. Cl.
*F01D 1/12* (2006.01)
*F01D 5/12* (2006.01)

(52) U.S. Cl. ..... 415/58.4; 415/228

(58) Field of Classification Search ..... 415/58.4, 415/228

See application file for complete search history.

(56) References Cited

U.S. PATENT DOCUMENTS

| | | | | |
|---|---|---|---|---|
| 3,462,071 | A | 8/1969 | Garve | |
| 3,887,295 | A | 6/1975 | Yu | |
| 4,248,566 | A | 2/1981 | Chapman et al. | |
| 4,479,755 | A | 10/1984 | Skoe | |
| 4,930,979 | A | 6/1990 | Fisher et al. | |
| 4,981,018 | A | 1/1991 | Jones et al. | |
| 4,990,053 | A | 2/1991 | Rohne | |
| 5,236,301 | A | 8/1993 | Palmer | |
| 5,246,335 | A | 9/1993 | Mitsubori et al. | |
| 5,497,615 | A * | 3/1996 | Noe et al. | 60/39.511 |
| 5,619,850 | A | 4/1997 | Palmer et al. | |
| 5,863,178 | A | 1/1999 | Scheinert et al. | |
| 6,183,195 | B1 | 2/2001 | Tremaine | |
| 6,585,482 | B1 | 7/2003 | Liotta et al. | |
| 6,623,239 | B2 | 9/2003 | Sahay et al. | |
| 6,648,594 | B1 | 11/2003 | Horner et al. | |
| 7,021,058 | B2 | 4/2006 | Scheinert | |
| 7,025,557 | B2 | 4/2006 | Japikse et al. | |
| 7,229,243 | B2 | 6/2007 | Nikpour et al. | |
| 7,305,827 | B2 | 12/2007 | Arnold et al. | |
| 2006/0198727 | A1 | 9/2006 | Arnold et al. | |
| 2007/0137201 | A1 | 6/2007 | Arnold et al. | |
| 2007/0217902 | A1 | 9/2007 | Sirakov et al. | |
| 2007/0224032 | A1 | 9/2007 | Gu et al. | |
| 2007/0269308 | A1 | 11/2007 | Wood | |
| 2007/0271921 | A1 | 11/2007 | Chen | |

* cited by examiner

*Primary Examiner* — Jarrett Stark
*Assistant Examiner* — Nicholas Tobergte
(74) *Attorney, Agent, or Firm* — Ingrassia Fisher & Lorenz, P.C.

(57) ABSTRACT

A compressor includes a housing, a rotor, an impeller, and a ported shroud. The rotor is mounted within the housing, and has a first leading edge and a first trailing edge. The rotor is operable, upon rotation thereof, to compress air and to discharge the air in an approximately axial direction. The impeller is mounted within the housing, and has a second leading edge and a second trailing edge. The impeller is operable, upon rotation thereof, to receive the air discharged from the rotor, to further compress the air, and to discharge the air in an approximately radial direction. The shroud at least partially surrounds the impeller. The shroud has an opening therein to at least facilitate allowing the air to travel upstream of the opening.

20 Claims, 3 Drawing Sheets

AXIAL-CENTRIFUGAL COMPRESSOR WITH PORTED SHROUD

TECHNICAL FIELD

The present invention relates to compressors, and more particularly, to axial-centrifugal compressors with shrouds.

BACKGROUND

Gas turbine engines are often used in aircraft, among other applications. For example, gas turbine engines used as aircraft main engines not only provide propulsion for the aircraft, but in many instances may also be used to drive various other rotating components such as, for example, generators, compressors, and pumps, to thereby supply electrical, pneumatic, and/or hydraulic power.

Generally, a gas turbine engine includes a combustor, a power turbine, and a compressor. During operation of the engine, the compressor draws in ambient air, compresses it, and supplies compressed air to the combustor. The compressor also typically includes a diffuser that diffuses the compressed air before it is supplied to the combustor. The combustor receives fuel from a fuel source and the compressed air from the compressor, and supplies high energy compressed air to the power turbine, causing it to rotate. The power turbine includes a shaft that may be used to drive the compressor.

The compressor of a gas turbine engine can take the form of an axial compressor, a centrifugal compressor, or some combination of both (i.e., an axial-centrifugal compressor). In an axial compressor, the flow of air through the compressor is at least substantially parallel to the axis of rotation. In a centrifugal compressor, the flow of air through the compressor is turned at least substantially perpendicular to the axis of rotation. An axial-centrifugal compressor includes an axial section (in which the flow of air through the compressor is at least substantially parallel to the axis of rotation) and a centrifugal section (in which the flow of air through the compressor is turned at least substantially perpendicular to the axis of rotation). While gas turbine engines are generally effective, in certain situations there may be a desire for improved efficiency of gas turbine engines, for example in gas turbine engines with axial-centrifugal compressors.

Accordingly, there is a need for an improved axial-centrifugal compressor for a gas turbine engine, for example that results in increased efficiency for the gas turbine engine. There is also a need for an improved gas turbine engine with an improved axial-centrifugal compressor that provides increased efficiency for the gas turbine engine. Furthermore, other desirable features and characteristics of the present invention will become apparent from the subsequent detailed description of the invention and the appended claims, taken in conjunction with the accompanying drawings and this background of the invention.

BRIEF SUMMARY

In accordance with an exemplary embodiment of the present invention, a compressor is provided. The compressor comprises a housing, a rotor, a impeller, and a ported shroud. The rotor is mounted within the housing, and has a first leading edge and a first trailing edge. The rotor is operable, upon rotation thereof, to compress air and to discharge the air in an approximately axial direction. The impeller is mounted within the housing, and has a second leading edge and a second trailing edge. The impeller is operable, upon rotation thereof, to receive the air discharged from the rotor, to further compress the air, and to discharge the air in an approximately radial direction. The shroud at least partially surrounds the impeller. The shroud has an opening therein to at least facilitate allowing the air to travel upstream of the opening.

In accordance with another exemplary embodiment of the present invention, a compressor is provided. The compressor comprises a housing, a rotor, a impeller, and a first shroud. The rotor is mounted within the housing, and has a first leading edge and a first trailing edge. The rotor is operable, upon rotation thereof, to compress air and to discharge the air in an approximately axial direction. The impeller is mounted within the housing, and has a second leading edge and a second trailing edge. The impeller is operable, upon rotation thereof, to receive the air discharged from the rotor, to further compress the air, and to discharge the air in an approximately radial direction. The first shroud at least partially surrounds the impeller. The first shroud has a first opening therein to at least facilitate allowing the air to circulate from the impeller to the first leading edge.

In accordance with yet another exemplary embodiment of the present invention, a gas turbine engine is provided. The gas turbine engine comprises a housing, a turbine, a combustor, and a compressor. The turbine is formed within the housing. The turbine is configured to receive a combustion gas, and is operable, upon receipt thereof, to supply a drive force. The combustor is formed within the housing. The combustor is configured to receive compressed air and fuel, and is operable, upon receipt thereof, to supply the combustion gas to the turbine. The compressor is formed within the housing, and is configured to supply the compressed air to the combustor. The compressor comprises a rotor, a impeller, and a shroud. The rotor is mounted within the housing, and has a first leading edge and a first trailing edge. The rotor is operable, upon rotation thereof, to compress air and to discharge the air in an approximately axial direction. The impeller is mounted within the housing, and has a second leading edge and a second trailing edge. The impeller is operable, upon rotation thereof, to receive the air discharged from the rotor and, to further compress the air, and to discharge the air in an approximately radial direction. The shroud at least partially surrounds the rotor. The shroud has an opening therein to at least facilitate allowing the air to circulate from the impeller to the first leading edge or the second leading edge.

DETAILED DESCRIPTION OF A PREFERRED EMBODIMENT

Figure 1:
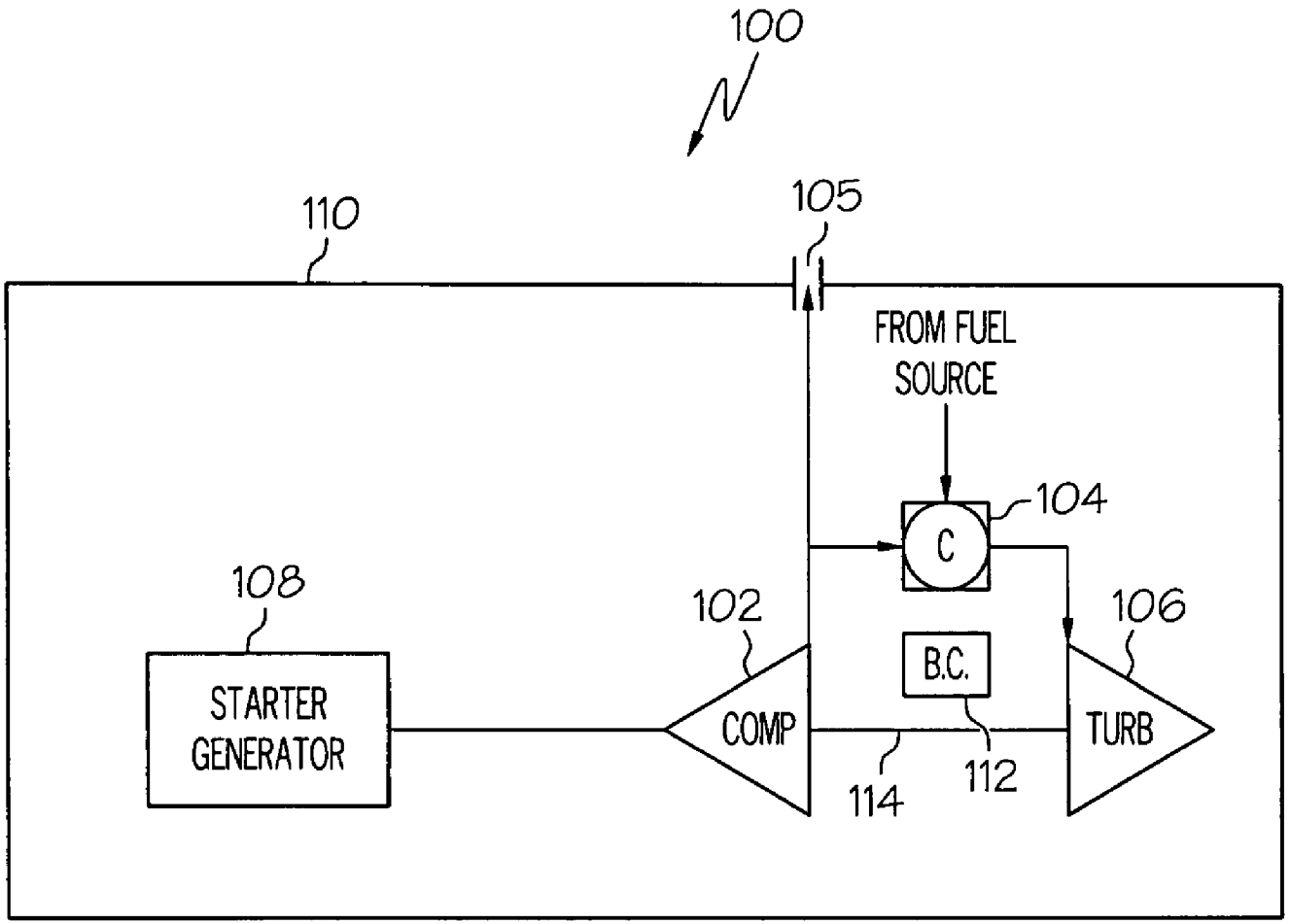
FIG. 1 is a schematic representation of a gas turbine engine, in accordance with an exemplary embodiment of the present invention.

FIG. 1 depicts an exemplary gas turbine engine 100 in simplified schematic form, in accordance with an exemplar embodiment of the present invention. The gas turbine engine 100 may be an auxiliary power unit (APU) for an aircraft, or any of a number of other different types of gas turbine engines. The gas turbine engine 100 includes a compressor 102, a combustor 104, a turbine 106, and a starter-generator unit 108, all preferably housed within a single containment housing 110. As shown in FIG. 1, certain gas turbine engines 100 may also have a bearing cavity 112 housed in proximity to the combustor 104, or otherwise in the interior of the gas turbine engine 100, that requires routings for service such as air and oil for proper functioning.

During operation of the gas turbine engine 100, the compressor 102 draws ambient air into the housing 110. The compressor 102 compresses the ambient air, and supplies a portion of the compressed air to the combustor 104, and may also supply compressed air to a bleed air port 105. The bleed air port 105, if included, is used to supply compressed air to a non-illustrated environmental control system. In a preferred embodiment, the compressor 102 comprises an axial-centrifugal compressor. Multiple preferred embodiments of the compressor 102 are depicted in FIGS. 2 and 3 and will be described further below in connection therewith in connection with certain preferred embodiments of the present invention.

The combustor 104 receives the compressed air from the compressor 102, and also receives a flow of fuel from a non-illustrated fuel source. The fuel and compressed air are mixed within the combustor 104, and are ignited to produce relatively high-energy combustion gas. The combustor 104 may be implemented as any one of numerous types of combustors now known or developed in the future. Non-limiting examples of presently known combustors include various can-type combustors, various reverse-flow combustors, various through-flow combustors, and various slinger combustors.

No matter the particular combustor 104 configuration used, the relatively high-energy combustion gas that is generated in the combustor 104 is supplied to the turbine 106. As the high-energy combustion gas expands through the turbine 106, it impinges on the turbine blades (not shown in FIG. 1), which causes the turbine 106 to rotate. The turbine 106 includes an output shaft 114 that drives the compressor 102, and specifically that drives any rotors or impellers of the compressor 102.

Figure 2:
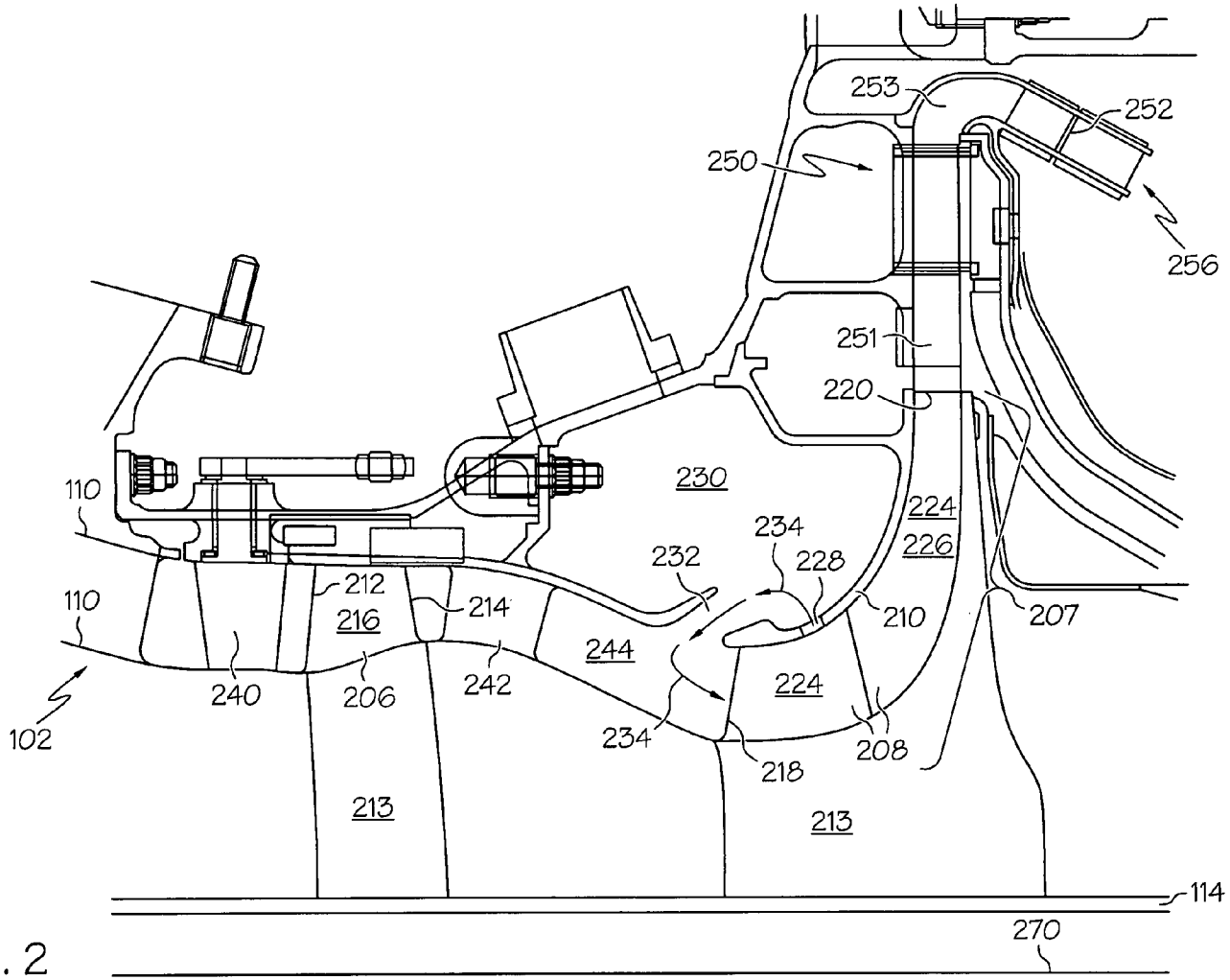
FIG. 2 is a cross sectional view of an exemplary compressor with a rotor, a impeller, and a ported shroud surrounding the impeller, that may be used in the gas turbine engine of FIG. 1, in accordance with a first exemplary embodiment of the present invention.
Figure 3:
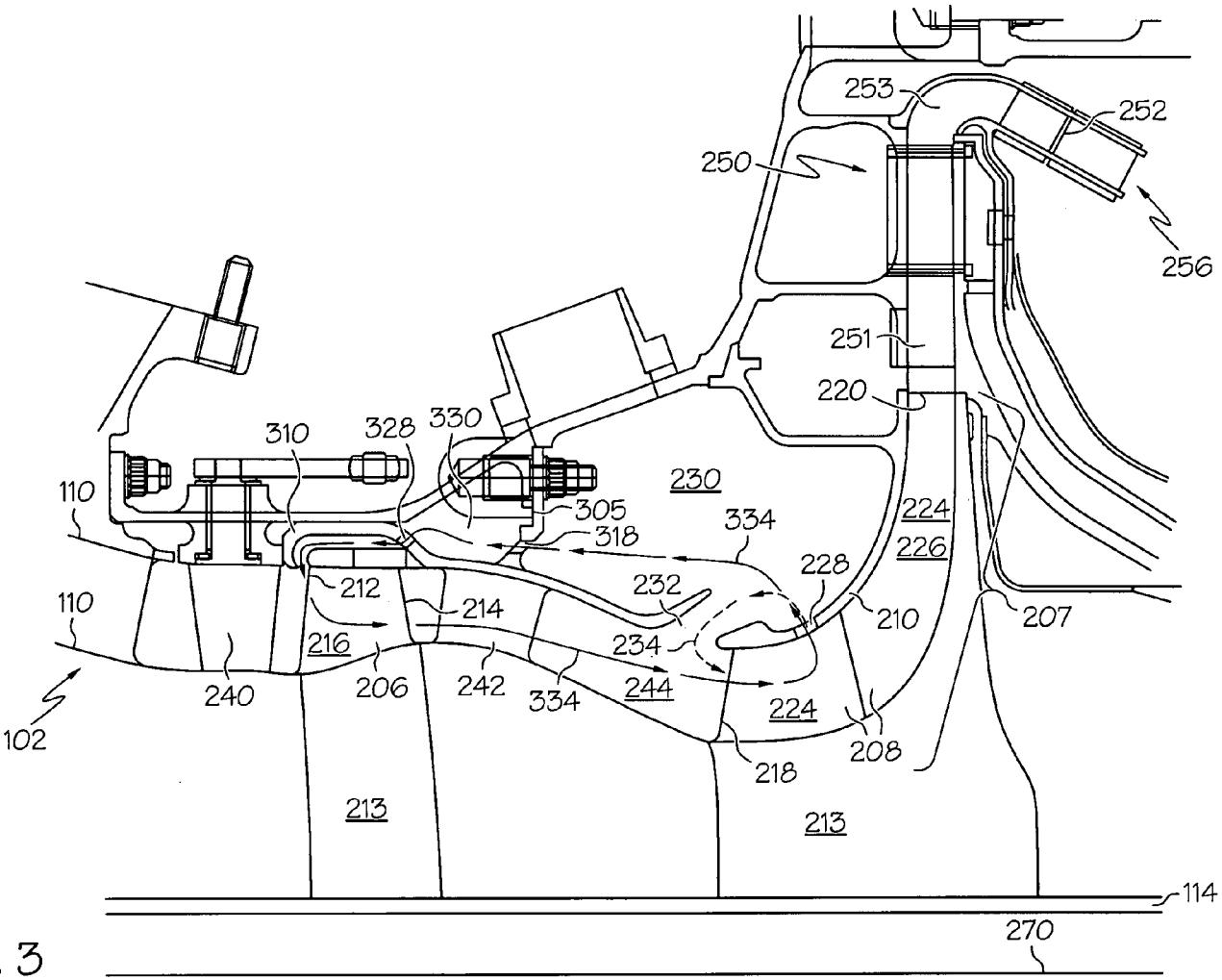
FIG. 3 is a cross sectional view of an alternate exemplary compressor, featuring a rotor, a impeller, a first ported shroud surrounding the impeller, and a second ported shroud surrounding the first motor, that may be used in the gas turbine engine of FIG. 1, in accordance with a second exemplary embodiment of the present invention.

Turning now to FIG. 2, a more detailed description of the compressor 102 will be provided in accordance with a first exemplary embodiment of the present invention. In the embodiment of FIG. 2, the compressor 102 is an axial-centrifugal compressor. The compressor 102 is formed within the housing 110, and includes a rotor 206, an impeller 208, and a shroud 210. In the depicted embodiment, the compressor 102 also includes an inlet guide vane 240, a stator 242, a transition duct 244, and a diffuser 250, also as depicted in FIG. 2.

The rotor 206 is coupled to the output shaft 114, and is thus rotationally driven by either the turbine 106 or the starter-generator unit 108 of FIG. 1, as described above. The rotor 206 is mounted within the housing 110. The rotor 206 is operable, upon rotation thereof, to compress air and to discharge the air in an approximately axial direction. In the depicted embodiment, the rotor 206 is mounted on the output shaft 114 via a hub 213. However, in other embodiments, the rotor 206 may be otherwise coupled to the output shaft 114, for example through one or more other forms of attachment thereto.

A plurality of spaced-apart rotor blades 216 extend generally radially through the rotor 206, preferably from the hub 213. The rotor blades 216 rotate around an engine axis 270. Together, the rotor blades 216 define a rotor leading edge 212 and a rotor trailing edge 214. As is generally known, when the rotor 206 is rotated, the rotor blades 216 draw air into the rotor 206, via the rotor leading edge 212 (and preferably via the above-mentioned inlet guide vane 240, as depicted in FIG. 2), and increase the velocity of the air to a relatively high velocity. The relatively high velocity air is then discharged from the rotor 206 in an approximately axial direction via the rotor trailing edge 214. The discharged air preferably then flows through the stator 242, in which the air is de-swirled and diffused, and then through the above-mentioned transition duct 244 and toward the impeller 208, as depicted in FIG. 2.

The impeller 208 is also coupled to the output shaft 114, and is thus rotationally driven by either the turbine 106 or the starter-generator unit 108, as described above. The impeller 208 is mounted within the shroud 210. The impeller 208 is operable, upon rotation thereof, to receive the air discharged from the rotor 206, to further compress the air, and to discharge the air in an approximately radial direction. In the depicted embodiment, the impeller 208 is mounted on the output shaft 114 via the hub 213. However, in other embodiments, the impeller 208 may be otherwise coupled to the output shaft 114, for example through one or more other forms of attachment thereto.

A plurality of spaced-apart impeller main blades 224 extend generally radially through the impeller 208, preferably from the hub 213. The impeller main blades 224 rotate around the engine axis 270. In addition, a plurality of spaced-apart impeller splitter blades 226 extend through a downstream portion 207 of the impeller 208. The impeller splitter blades 226 extend generally radially through the downstream portion 207 of the impeller 208, preferably from the hub 213. Each impeller splitter blade 226 preferably is disposed between two of the impeller main blades 224. The impeller splitter blades 226 also preferably rotate around the engine axis 270. Together, the impeller main blades 224 and the impeller splitter blades 226 define an impeller leading edge 218 and an impeller trailing edge 220. As is generally known, when the impeller 208 is rotated, the impeller main blades 224 and the impeller splitter blades 226 draw air into the impeller 208 via the impeller leading edge 218 (and preferably via the above-mentioned transition duct 244, as depicted in FIG. 2), and increase the velocity of the air to a relatively higher velocity. The relatively higher velocity air is then discharged from the impeller 208 in an approximately radial direction via the impeller trailing edge 220. The discharged air preferably then flows through the diffuser 250, in which the air is diffused and directed toward the combustor 104 of FIG. 2 (not depicted in FIG. 2).

The shroud 210 is disposed adjacent to, and partially surrounds, the impeller main blades 224 and the impeller splitter blades 226. The shroud 210, among other things, cooperates with an annular inlet duct 232 to direct the air drawn into the gas turbine engine 100 by the compressor 102 into the impeller 208 and also facilitates circulation of the air, as described below.

The shroud 210 has an opening 228 formed therein to at least facilitate allowing the air to travel upstream of the opening 228. The opening 228 may include a port, a single opening, or multiple openings in or through the shroud 210. In the embodiment of FIG. 2, the opening 228 allows the air to circulate from within the impeller 208 through a plenum 230. The plenum 230 is formed within the housing 110 proximate the shroud 210 and the transition duct 244, and fluidly couples the opening 228 to the transition duct 244. The air travels from the opening 228 and through the plenum 230 toward the transition duct 244, and then returns to the impeller 208 via the impeller leading edge 218 along a first re-circulation pathway 234. The air thus re-circulates from within the impeller 208 to the impeller leading edge 218 via the opening 228, the plenum 230, and the transition duct 244 along the first re-circulation pathway 234.

In this mode of recirculation, the invention in this exemplary embodiment increases the efficiency of the impeller 108, in addition to the traditional increases in surge margin of the impeller 108. While the increase in surge margin is well known within the compressor design practice, the fact that this type of recirculation can increases compressor efficiency has only now been discovered through recent test data. Accordingly, the application of this type of recirculation for the purpose of increasing compressor efficiency is highly novel.

The diffuser 250 is a radial vane diffuser that is disposed adjacent to and coupled to the impeller 208. The diffuser 250 is configured to receive the flow of compressed air with a radial component from the impeller 208, and to direct the air to a diffused annular flow having an axial component. The diffuser 250 additionally reduces the velocity of the air and increases the pressure of the air to a higher magnitude. In the depicted embodiment, the diffuser 250 includes a radial section 251, an axial section 252, and a transition 253. The transition 253 includes a bend, and extends between the radial section 251 and the axial section 252. Preferably, the transition 253 provides a continuous turn between the radial section 251 and the axial section 252. The radial diffuser 250 thus diffuses the air and directs the air from an approximately radial flow to an approximately axial flow.

Turning now to FIG. 3, a more detailed description of the compressor 102 will be provided in accordance with a second exemplary embodiment of the present invention. In this second embodiment of FIG. 3, the compressor 102 is an axial-centrifugal compressor, similar to the first embodiment of FIG. 2. Also similar to the first embodiment, the compressor 102 in this second embodiment of FIG. 3 is also formed within the housing 110, and includes a rotor 206, an impeller 208, and a first shroud 210, along with an inlet guide vane 240, a stator 242, a transition duct 244, and a diffuser 250. Unlike the first embodiment of FIG. 1, however, the compressor 102 in the second embodiment of FIG. 3 also includes a second shroud 310 and a second re-circulation pathway 334, among other differences depicted in FIG. 3 and described below.

Similar to the first embodiment, the rotor 206 of FIG. 3 is coupled to the output shaft 114, and is thus rotationally driven by either the turbine 106 or the starter-generator unit 108, as described above. The rotor 206 of FIG. 3 includes the same features described above in connection with FIG. 2.

Also similar to the first embodiment, the impeller 208 of FIG. 3 is coupled to the output shaft 114, and is thus rotationally driven by either the turbine 106 or the starter-generator unit 108, as described above. The impeller 208 of FIG. 3 includes the same features described above in connection with FIG. 2.

The first shroud 210 of FIG. 3 is disposed adjacent to, and partially surrounds, the impeller main blades 224 and the impeller splitter blades 226 of the impeller 208. The first shroud 210, among other things, cooperates with an annular inlet duct 232 to direct the air drawn into the gas turbine engine 100 by the compressor 102 into the impeller 208 and also facilitates circulation of the air, as described below.

The first shroud 210 of FIG. 3 has a first opening 228 formed therein to at least facilitate allowing the air to travel upstream of the first opening 228. The first opening 228 may include a port, a single opening, or multiple openings in or through the shroud first 208. In the embodiment of FIG. 3, the first opening 228 allows the air to circulate from within the impeller 208 through a first plenum 230. The first plenum 230 is formed within the housing 110 proximate the first shroud 210, the transition duct 244, and a flange 305. In one exemplary embodiment, the first plenum 230 couples the first opening 238 to the transition duct 244. In addition, as shown in FIG. 3, in the second embodiment the air travels through the first plenum 230 upstream toward the rotor 206, as described in greater detail below.

Specifically, in the embodiment of FIG. 3, a flange 305 is mounted within the housing 110, and includes a second opening 318 therein. The second opening 318 may include a port, a single opening, or multiple openings in or through the flange 305. The air from the first opening 238 travels via the second re-circulation pathway 334 through the first plenum 230 and then through the second opening 318 toward a second plenum 330.

The second plenum 330 is formed within the housing proximate the flange 305 and the rotor 206, and fluidly couples the first plenum 230 to the rotor 206. Once the air travels through the second opening 318, the air then travels through the second plenum and toward the second shroud 310 proximate the rotor 206, as shown in FIG. 3. The second shroud 310 of FIG. 3 is disposed adjacent to, and partially surrounds, the rotor blades 216 of the rotor 206. The second shroud 310 has a third opening 328 formed therein to facilitate re-circulation of air from the impeller 208 to the rotor 206 and back to the impeller 208. The third opening 328 may include a port, a single opening, or multiple openings in or through the second shroud 310.

Specifically, the air travels from the second plenum 330 through the third opening 328 and toward the rotor 206. The air then continues along the second re-circulation pathway 334 through the stator 242 and the transition duct 244 until the air returns to the impeller 208 via the impeller leading edge 218. The air thus re-circulates from within the impeller 208 to the rotor 206 via the first opening 238, the first plenum 230, the second opening 318, the second plenum 330, and the third opening 328, and ultimately re-circulates back to the impeller 208 via the rotor 206, the stator 242, and the transition duct 244, all along the second re-circulation pathway 334. In addition, in certain implementations, some of the air may also be re-circulated from within the impeller 208 directly back to the impeller leading edge 218 via the first plenum 230 and the transition duct 244 along the first re-circulation pathway 234 of FIG. 2, for example as shown in phantom in FIG. 3.

The diffuser 250 of FIG. 3 is a radial vane diffuser that is disposed adjacent to and coupled to the impeller 208. The diffuser 250 is configured to receive the flow of compressed air with a radial component from the impeller 208, and to direct the air to a diffused annular flow having an axial component. The diffuser 250 includes the features described above in connection with FIG. 1.

Accordingly, improved axial-centrifugal compressors are provided for gas turbine engines that provide for improved circulation of air within the compressors and the gas turbine engines. Additionally, improved gas turbine engines are provided with such improved axial-centrifugal compressors. Recent test data indicates that the features depicted in FIGS. 1-3 and described herein, including the use of ported shrouds in axial-centrifugal compressors, have resulted in an unexpected efficiency gain for the gas turbine engines and the compressors for use therein, in addition to the more traditional benefits of increased surge margins and increased high speed flow capacity.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A compressor comprising:

a housing;

a rotor mounted within the housing and having a first leading edge and a first trailing edge, the rotor operable, upon rotation thereof, to compress air and to discharge the air in an approximately axial direction;

an impeller mounted within the housing having a second leading edge and a second trailing edge, the impeller operable, upon rotation thereof, to receive the air discharged from the rotor, to further compress the air, and to discharge the air in an approximately radial direction; and a shroud at least partially surrounding the impeller, the shroud having an opening therein to at least facilitate allowing the air to travel upstream of the opening away from the impeller and to return to the impeller at a location that is upstream of the opening.

2. The compressor of claim 1, wherein the opening allows the air to circulate from the impeller from a second location that is downstream of the second leading edge to the second leading edge via the opening.

3. The compressor of claim 2, wherein the housing forms a plenum fluidly coupling the opening to the second leading edge.

4. The compressor of claim 3, wherein the housing forms a transition duct fluidly coupling the plenum to the second leading edge.

5. The compressor of claim 4, wherein the transition duct is formed between the rotor and the impeller.

6. The compressor of claim 5, further comprising:

a stator mounted within the housing between the rotor and the transition duct.

7. The compressor of claim 1, further comprising:

a radial diffuser coupled to the impeller, the radial diffuser configured to diffuse the air and to direct the air from an approximately radial flow to an approximately axial flow.

8. A compressor comprising:

a housing;

a rotor mounted within the housing and having a first leading edge and a first trailing edge, the rotor operable, upon rotation thereof, to compress air and to discharge the air in an approximately axial direction;

an impeller mounted within the housing having a second leading edge and a second trailing edge, the second leading edge being downstream from the rotor and upstream form the second trailing edge, the impeller operable, upon rotation thereof, to receive the air discharged from the rotor, to further compress the air, and to discharge the air in an approximately radial direction; and a first shroud at least partially surrounding the impeller, the first shroud having a first opening therein to at least facilitate allowing the air to circulate upstream from the impeller to the first leading edge.

9. The compressor of claim 8, wherein the housing forms a first plenum fluidly coupling the first opening to the first leading edge.

10. The compressor of claim 9, further comprising:

a second shroud at least partially surrounding the rotor, the second shroud having a second opening therein fluidly coupling the first plenum to the first leading edge.

11. The compressor of claim 10, further comprising:

a flange mounted within the housing between the first plenum and the second opening, the flange having a third opening therein to at least facilitate allowing movement of the air from the first plenum toward the second opening.

12. The compressor of claim 11, wherein the housing further forms a second plenum between the flange and the second shroud, the second plenum fluidly coupling the third opening to the second opening.

13. The compressor of claim 8, wherein the rotor is disposed upstream of the impeller.

14. The compressor of claim 8, wherein the housing forms a transition duct fluidly coupling the rotor to the impeller.

15. The compressor of claim 14, further comprising:

a stator mounted within the housing between the rotor and the transition duct.

16. The compressor of claim 15, further comprising:

a radial diffuser coupled to the impeller, the radial diffuser configured to diffuse the air and to direct the air from an approximately radial flow to an approximately axial flow.

17. A gas turbine engine, comprising:

a housing;

a turbine formed within the housing and configured to receive a combustion gas and operable, upon receipt thereof, to supply a drive force;

a combustor formed within the housing and configured to receive compressed air and fuel and operable, upon receipt thereof, to supply the combustion gas to the turbine; and a compressor formed within the housing and configured to supply the compressed air to the combustor, the compressor comprising:

a rotor mounted within the housing and having a first leading edge and a first trailing edge, the rotor operable, upon rotation thereof, to compress air and to discharge the air in an approximately axial direction;

an impeller mounted within the housing having a second leading edge and a second trailing edge, the second leading edge being downstream from the rotor and upstream form the second trailing edge, the impeller operable, upon rotation thereof, to receive the air discharged from the rotor and, to further compress the air, and to discharge the air in an approximately radial direction; and a shroud at least partially surrounding the rotor, the shroud having an opening therein to at least facilitate allowing the air to circulate from the impeller upstream to the first leading edge or the second leading edge.

18. The gas turbine engine of claim 17, wherein the housing forms a plenum fluidly coupling the opening to the second leading edge.

19. The gas turbine engine of claim 17, wherein the housing forms a plenum fluidly coupling the opening to the first leading edge.

20. The gas turbine engine of claim 19, further comprising:

a second shroud at least partially surrounding the rotor, the second shroud having a second opening therein to at least facilitate allowing movement of the air from the plenum toward the first leading edge.

* * * * *